US010036387B2

(12) United States Patent
Shenoi et al.

(10) Patent No.: US 10,036,387 B2
(45) Date of Patent: Jul. 31, 2018

(54) PORT PLATE OF A FLAT SIDED LIQUID RING PUMP HAVING A GAS SCAVENGE PASSAGE THEREIN

(71) Applicant: GARDNER DENVER NASH LLC, Charleroi, PA (US)

(72) Inventors: Ramesh Balkunge Shenoi, Orangeburg, NY (US); Charles Howard Beers, Milford, CT (US); Richard Gerard Cadotte, Canonsburg, PA (US)

(73) Assignee: GARDNER DENVER NASH LLC, Charleroi, PA (US)

( * ) Notice: Subject to any disclaimer, the term of this patent is extended or adjusted under 35 U.S.C. 154(b) by 0 days.

(21) Appl. No.: 15/617,077

(22) Filed: Jun. 8, 2017

(65) Prior Publication Data

US 2017/0268512 A1 Sep. 21, 2017

Related U.S. Application Data

(63) Continuation of application No. 13/674,736, filed on Nov. 12, 2012, now Pat. No. 9,689,387.

(Continued)

(51) Int. Cl.
*F04C 19/00* (2006.01)

(52) U.S. Cl.
CPC ..... *F04C 19/007* (2013.01); *F04C 19/004* (2013.01); *F04C 19/005* (2013.01); *F04C 2220/20* (2013.01); *Y10T 29/49238* (2015.01)

(58) Field of Classification Search
CPC ..... F04C 19/00; F04C 19/004; F04C 19/005; F04C 19/007

(Continued)

(56) References Cited

U.S. PATENT DOCUMENTS 1,091,529 A * 3/1914 Nash ..... F04C 19/007 417/68
1,180,613 A * 4/1916 Siemen ..... F04C 19/008 417/68

(Continued)

FOREIGN PATENT DOCUMENTS

JP 59131198 A 7/1984
WO 2010071651 A1 6/2010

OTHER PUBLICATIONS

Office Action from the Japanese Patent Office for Application No. 2015-539914 dated Jun. 13, 2017 (7 pages).

(Continued)

*Primary Examiner* — Alexander Comley
(74) *Attorney, Agent, or Firm* — Michael Best & Friedrich LLP

(57) ABSTRACT

A liquid ring pump includes a planar port plate having first and second planar walls, a sidewall which defines a shaft receiving aperture, an inlet, and an outlet. An opening is formed in the port plate and includes an open end that extends through the sidewall and an open face that extends through the first planar wall. A rotor shaft is rotatable about a central axis and is positioned such that a portion of the rotor shaft extends into the shaft receiving aperture. An aperture is formed in the port plate and positioned substantially opposite the opening. The opening, a space defined between the rotor shaft and the sidewall, and the aperture, cooperate to define a channel that extends between a first side of the shaft receiving aperture and a second side of the shaft receiving aperture, wherein the channel is formed entirely coplanar with the port plate.

15 Claims, 10 Drawing Sheets

Related U.S. Application Data

(60) Provisional application No. 61/720,175, filed on Oct. 30, 2012.

(58) Field of Classification Search
USPC ..... 417/68
See application file for complete search history.

(56) References Cited

U.S. PATENT DOCUMENTS 2,195,174 A * 3/1940 Jennings ..... F04C 19/004 417/434
2,911,137 A 11/1959 Edwards
3,108,738 A * 10/1963 Luhmann ..... F04C 19/004 417/68
3,707,337 A * 12/1972 Segebrecht ..... F04C 19/007 417/68
3,884,596 A * 5/1975 Hoffmeister ..... F04C 19/007 417/437
3,894,812 A 7/1975 Huse
4,251,190 A 2/1981 Brown et al.
4,392,783 A * 7/1983 Jozepaitis ..... F04C 19/007 417/68
4,522,560 A * 6/1985 Lubke ..... F04C 19/007 415/208.2
4,545,730 A * 10/1985 Lubke ..... F04C 19/007 417/68
4,613,283 A * 9/1986 Haavik ..... F04C 19/008 417/68
4,679,987 A * 7/1987 Olsen ..... F04C 19/004 417/54
4,755,107 A * 7/1988 Trimborn ..... F04C 19/007 417/68
4,756,672 A * 7/1988 Trimborn ..... F04C 19/004 417/68
4,795,315 A * 1/1989 Schultze ..... F04C 19/005 417/244
4,850,808 A * 7/1989 Schultze ..... F04C 29/122 417/68
5,073,089 A * 12/1991 Trimborn ..... F04C 19/007 417/68
5,356,268 A * 10/1994 Lengyel ..... F04C 19/008 417/68
5,464,329 A * 11/1995 Senoo ..... F04C 19/004 417/68
5,489,195 A * 2/1996 Domagalla ..... F04C 19/007 29/890.132
5,588,806 A * 12/1996 Trimborn ..... F04C 19/004 417/54
5,605,445 A * 2/1997 Trimborn ..... F04C 19/004 417/68
5,735,674 A * 4/1998 Domagalla ..... F04C 19/004 417/68
5,769,609 A * 6/1998 Plescher ..... F04C 19/007 417/68
6,354,808 B1 * 3/2002 Shenoi ..... F04C 19/004 417/68
2002/0085922 A1 * 7/2002 Cavatorta ..... F04C 19/007 417/68
2008/0175723 A1 * 7/2008 Muhs ..... F01C 21/106 417/68
2011/0243758 A1 * 10/2011 Bissell ..... F04C 19/001 417/68
2011/0286840 A1 * 11/2011 Bissell ..... F01C 21/10 415/200
2012/0076671 A1 * 3/2012 Bissell ..... F04C 19/008 417/68

OTHER PUBLICATIONS

International Search Report related to companion case PCT/US2013/067292 dated Mar. 19, 2014 (2 pages).
Written Opinion of the International Searching Authority related to companion case PCT/US2013/067292 dated Mar. 19, 2014 (4 pages).
28 Search History for PCT /US2013/067292, dated Feb. 28, 2014 (3 pages).
International Search Report in connection with WO 2010/071651, previously disclosed.
PCT International Preliminary Report on Patentability for PCT Application No. PCT/US2013/067292 dated May 14, 2015 (6 pages).

* cited by examiner

PORT PLATE OF A FLAT SIDED LIQUID RING PUMP HAVING A GAS SCAVENGE PASSAGE THEREIN

PRIOR APPLICATION DATA

This application is a continuation of U.S. application Ser. No. 13/674,736 filed Nov. 12, 2012, now U.S. Pat. No. 9,689,387, which claims priority to U.S. Provisional Application No. 61/720,175 filed Oct. 30, 2012, the contents of both are fully incorporated herein by reference.

BACKGROUND

The present invention concerns a liquid ring pump that has a passage which scavenges gas trapped in a rotor bucket of a liquid ring pump after the bucket has swept past a closing edge of an outlet in a port plate and before the bucket opens into an inlet of the port plate. The passage is in the port plate angularly between the closing edge of the port plate outlet and the leading edge of the port plate inlet.

Liquid ring pumps are well known. Generally a liquid ring pump includes a housing; a rotor within the housing; a shaft extending into the housing on which the rotor is fixedly mounted; and a motor coupled to the shaft. During operation, the housing is partially filled with operating liquid so that when the rotor is rotating, the rotor blades engage the operating or pumping liquid and cause it to form an eccentric ring that diverges and converges in the radial direction relative to the shaft. Where the liquid is diverging from the shaft, the resulting reduced pressure in the spaces between adjacent rotor blades of the rotor assembly (buckets) constitutes a gas intake zone, low pressure zone. Where the liquid is converging towards the shaft, the resulting increased pressure in the spaces between adjacent rotor blades (buckets) constitutes a gas compression zone U.S. Pat. No. 4,850,808, Schultze, recites that in a conically or cylindrically ported liquid ring pump, compressed gas that would otherwise be carried over from the compression zone to the intake zone of the pump is made to bypass the intake zone by passing through a first aperture in the port member into a clearance between the rotor shaft and the port member and then through a second aperture in the port member from the clearance to an initial portion of the compression on zone.

U.S. Pat. No. 5,769,609, Plescher, recites that in a liquid-ring compressor having a rotor mounted in a compressor housing, the rotor is mounted eccentrically relative to the center axis of the compressor housing. At least one control disk is arranged on one of the end faces of the rotor. The control disk is provided with a suction slot and a pressure slot for the feed and discharge of the medium to be compressed, respectively. The control disk also has an encircling distribution groove in the area covered radially by the hub of the rotor. Operating liquid is introduced into a feed opening, which leads to the distribution groove, to seal an axial gap between the control disk and the rotor hub. A blocking element projects radially into the distribution groove and is provided on the side of the feed opening that has the greater pressure differential between the pressure of the operating liquid entering the feed opening and the pressure in the rotor cells. The blocking element improves the sealing of the axial gap.

U.S. Pat. No. 6,354,808, Shenoi, recites that liquid ring pumps, of the type having a port structure that extends into an annular recess in an end of the rotor, have several parts that are designed so that they can be used to make pumps having either relatively demanding service requirements or substantially less demanding service requirements. Some of these parts can be substantially exactly the same in both final pump configurations. Others of these parts may be castings that differ substantially only in some subsequent machining in order to adapt them for each final pump configuration. Some of the final pump configurations have more compact mechanical seal structures and/or improved structures for supplying liquid to the seal structures.

International publication WO 2010 071651 is directed to a liquid ring pump that has a channel in a portion of a liquid ring pump. The channel has a first opening which opens into a first bucket formed by rotor blades. The first opening is located along an arcuate path between a closing edge of an inlet port and a leading edge of a discharge port. The inlet port and discharge port are in a port plate of the liquid ring pump. The channel has a second opening which opens into a second bucket formed by rotor blades. The second opening is on an arcuate path between a closing edge of the discharge port and a leading edge of the inlet port. A fluid pathway interconnects the first and second openings. At least a portion of the liquid ring pump forming the channel is disposed in a circumferential cylindrical cavity, wherein the cavity is formed from a plurality of axially extending rotor blade ends. The portion of the liquid ring pump providing the channel can be a removable cylinder. The channel is isolated and sealed off from the discharge port and the inlet port of the port plate when the pump is in the running mode.

SUMMARY

In one aspect the invention is embodied in a partial assembly of a liquid ring pump. The pump has a pump head. A port plate is coupled to the pump head. The port plate has a side wall which defines a shaft receiving aperture. A rotor shaft is disposed in said shaft receiving aperture. A space is between the sidewall and a portion of the shaft radially opposite the sidewall. A rotor is fixedly coupled to the shaft. The rotor has a plurality of blades which are arranged about a central axis of the rotor. Each blade of the plurality of blades is adjacent at least two other blades. The plurality of blades forms a plurality of pairs of adjacent blades. Between each pair of adjacent blades is a bucket. The adjacent blades form a plurality of buckets. Rotation of the shaft in the shaft receiving aperture rotates the rotor and plurality of buckets about the central axis.

The port plate defines an inlet and an outlet. The inlet has a closing edge and a leading edge. The outlet has a closing and a leading edge. The port plate has an opening with a first end at a first section of the opening and a second end at a second section of the opening. The first section opens through a portion of a surface forming a first face of the port plate. The second section opens at the second end into the shaft receiving aperture. The first and second sections are continuous. The first section is angularly between the closing edge of the outlet and leading edge of the inlet. A length measured from the first section to the inlet's leading edge is less than a length measured from the first section to the outlet's leading edge. The length is measured along a straight line. The first section does not open into the outlet or inlet;

Rotation of the buckets will rotate a first one of the buckets, in a direction of rotation to a position between the leading edge of the inlet and closing edge of the outlet. When said first one of said buckets has rotated to the position between the leading edge of the inlet and the closing edge of said outlet, said bucket overlaps said first section of said opening and said first section of said opening opens into said bucket, said buckets at said position are between said leading and closing edge without overlapping said inlet and outlet.

DETAILED DESCRIPTION

Figure 1:
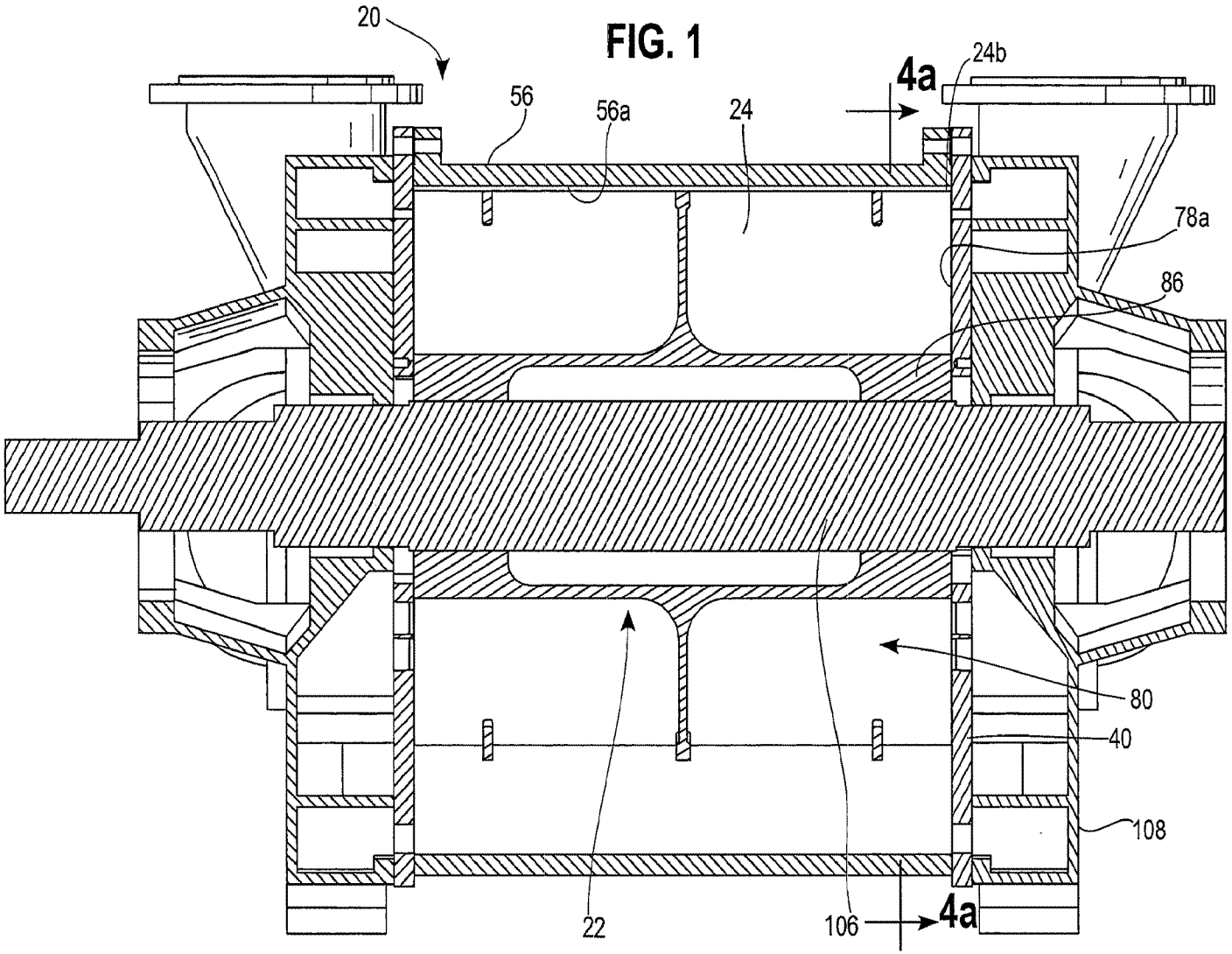
FIG. 1 is a simplified stripped down sectional view of a liquid ring pump embodying the present invention; the sectional view is taken along the length of the shaft's central axis.
Figure 2:
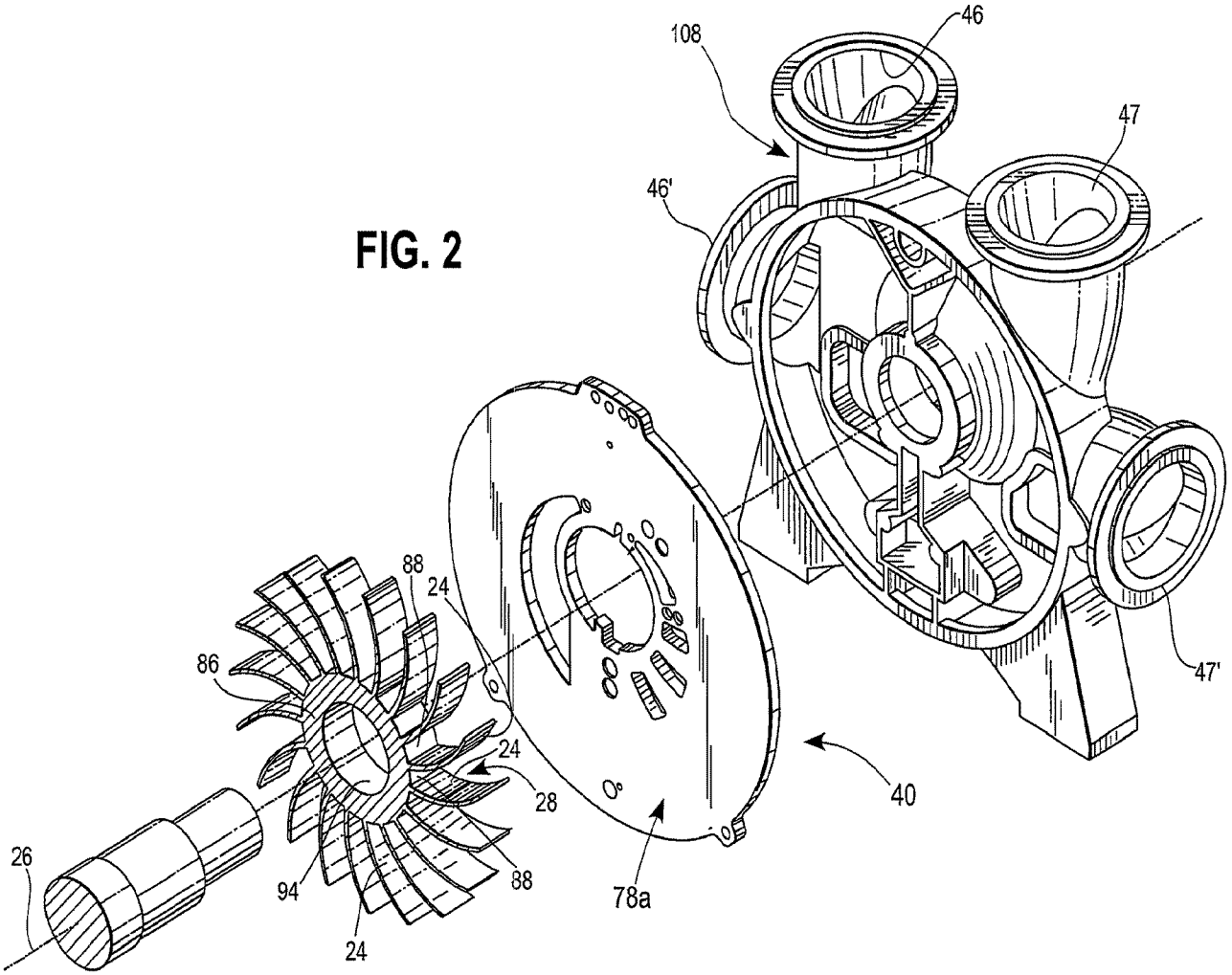
FIG. 2 is a stripped down and simplified exploded isometric view of a partial assembly of the liquid ring pump shown in FIG. 1; the rotor and shaft have been sectioned along view line 4*a*-4*a*; the view looks into a first face of a head of a liquid ring pump.
Figure 3:
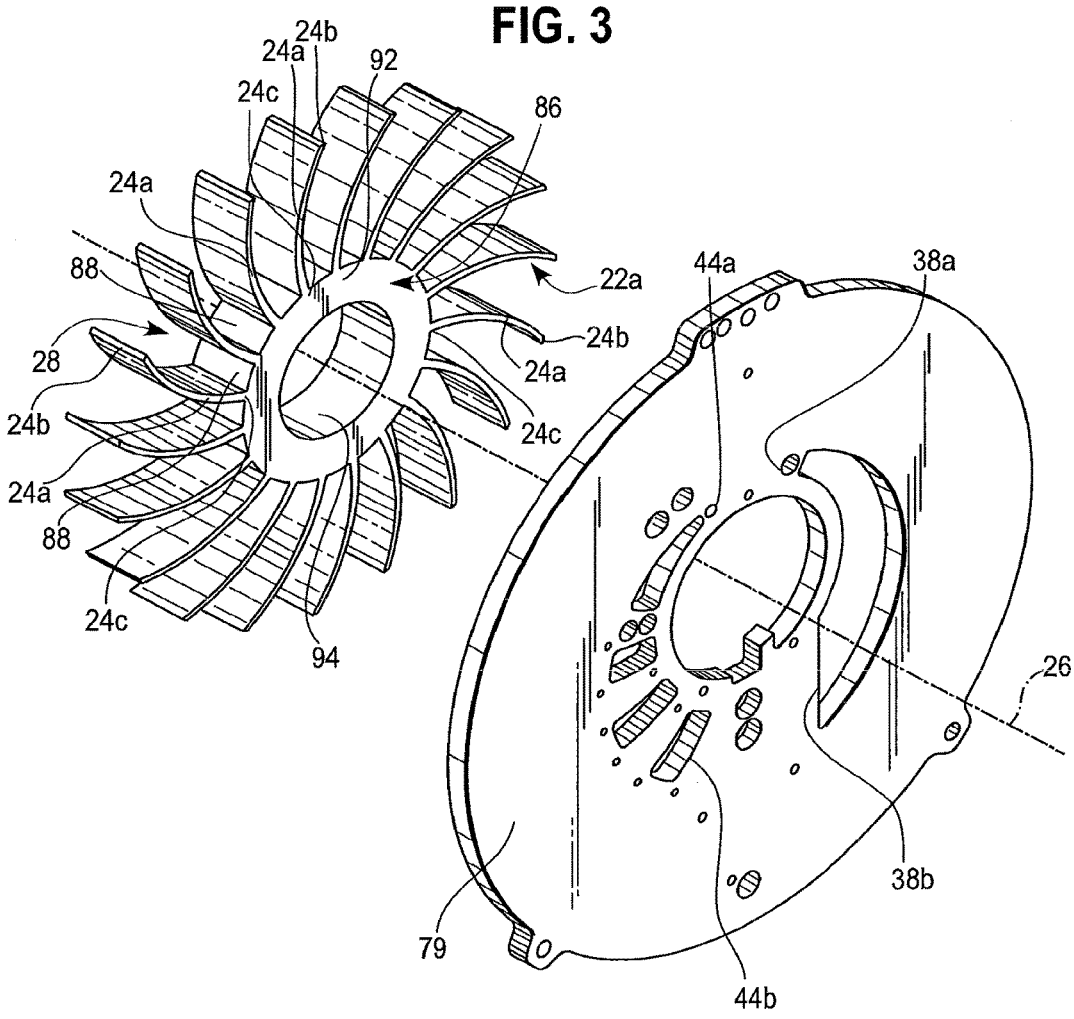
FIG. 3 is an isometric view of the rotor shown in FIG. 2; the view is looking into a face of the rotor; the face of the rotor, when the rotor is assembled, faces the valve port plate and first face of the head.
Figure 4A:
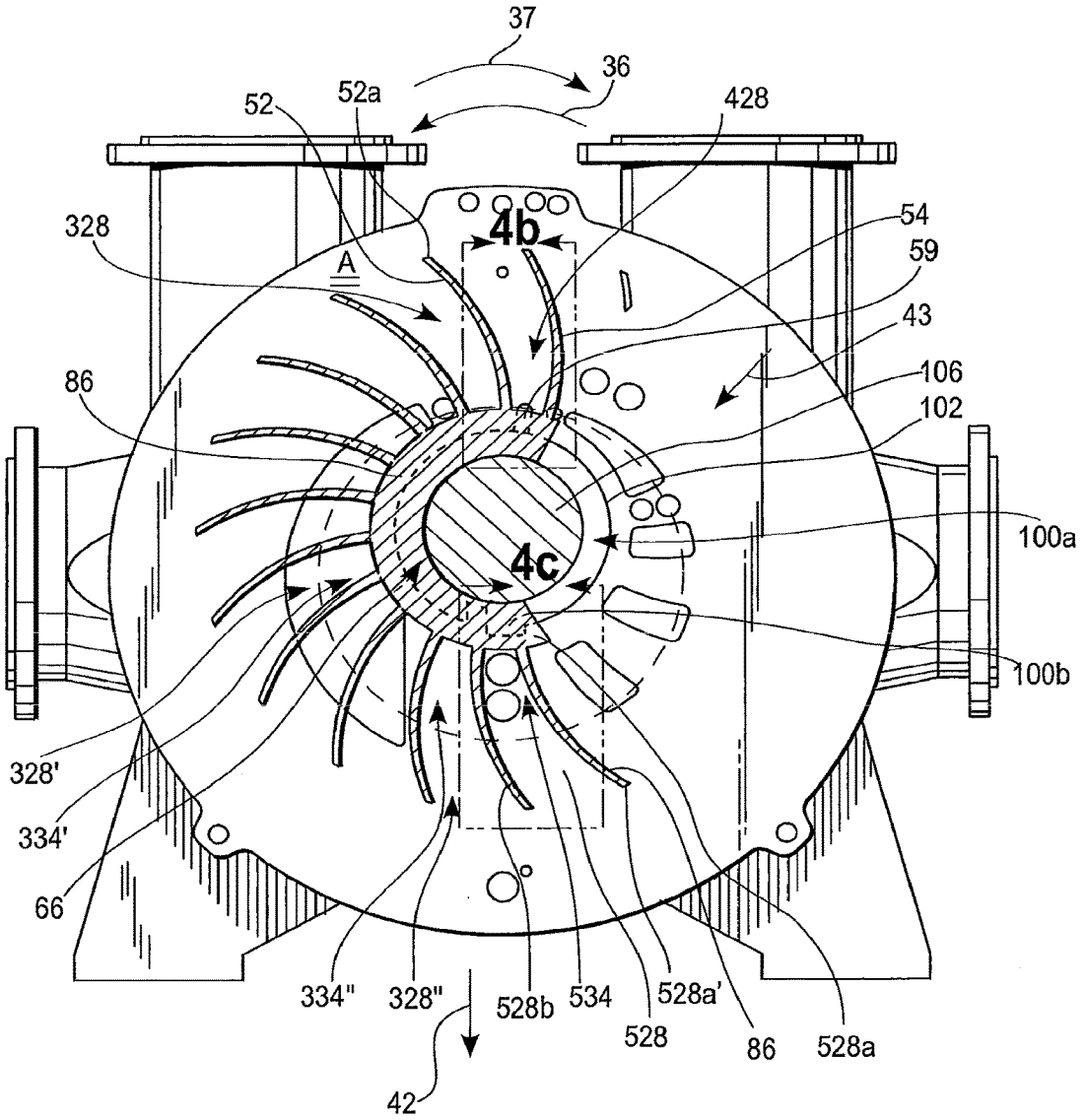
FIG. 4*a* is a simplified sectional view of the liquid ring pump of FIG. 1; the section is perpendicular the pump shaft's axis looking into the rotor, port plate and first face of the head and taken along view line 4*a*-4*a*; a portion of the rotor has been cut-away to show a portion of the port plate normally hidden by the hub and also show a space between the shaft and a sidewall of the of the port plate normally hidden by the hub.
Figure 4B:
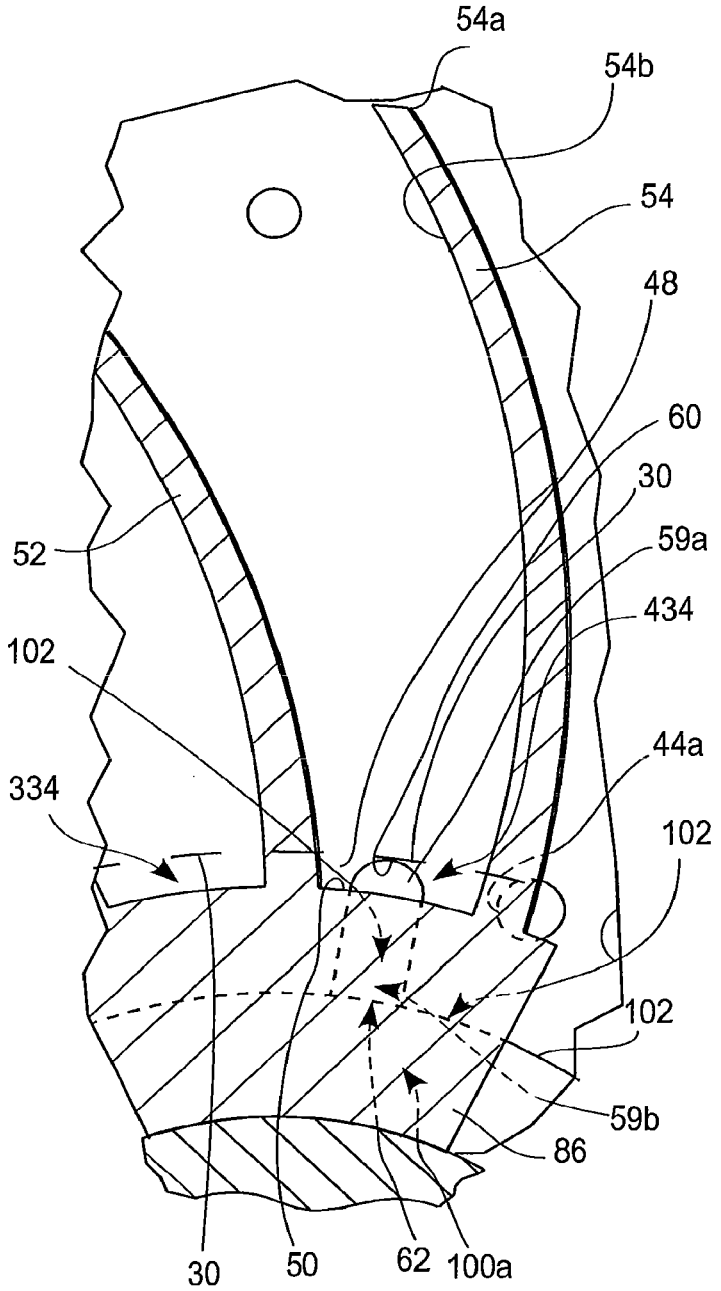
FIG. 4*b* is the close-up detail indicated at 4*b* of FIG. 4*a*.
Figure 4C:
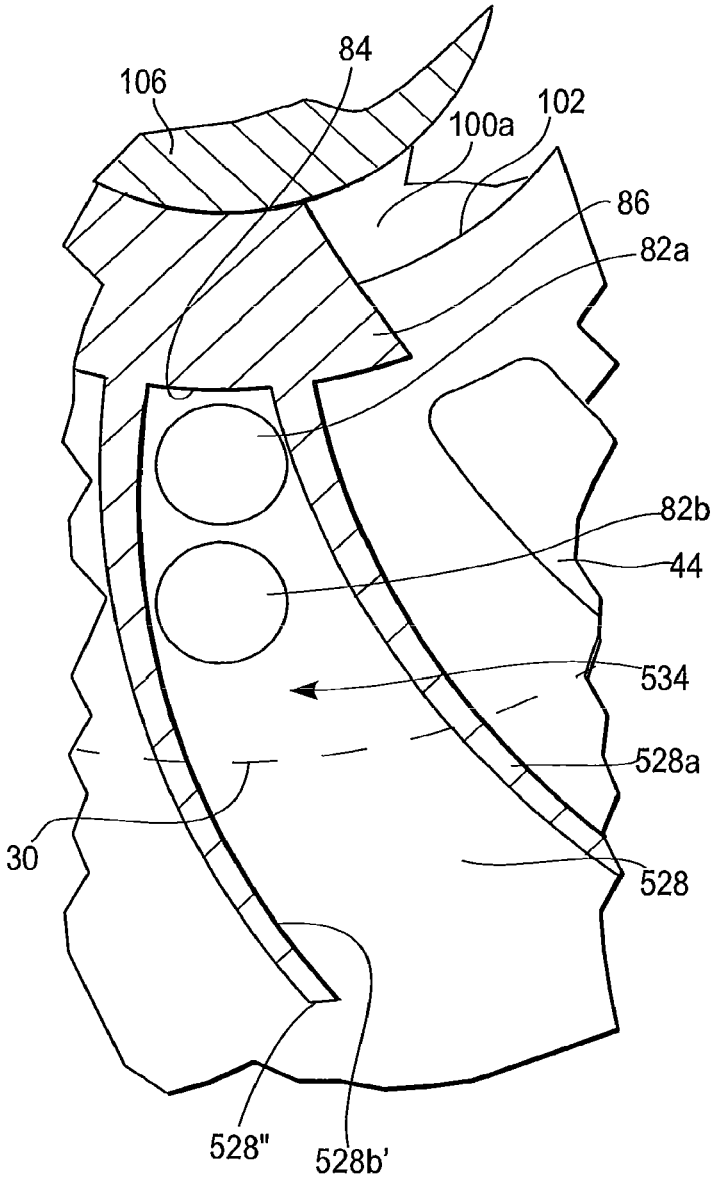
FIG. 4C is a close-up of the detail indicated at 4*c* in FIG. 4*a*, phantom lines have been omitted.
Figure 5:
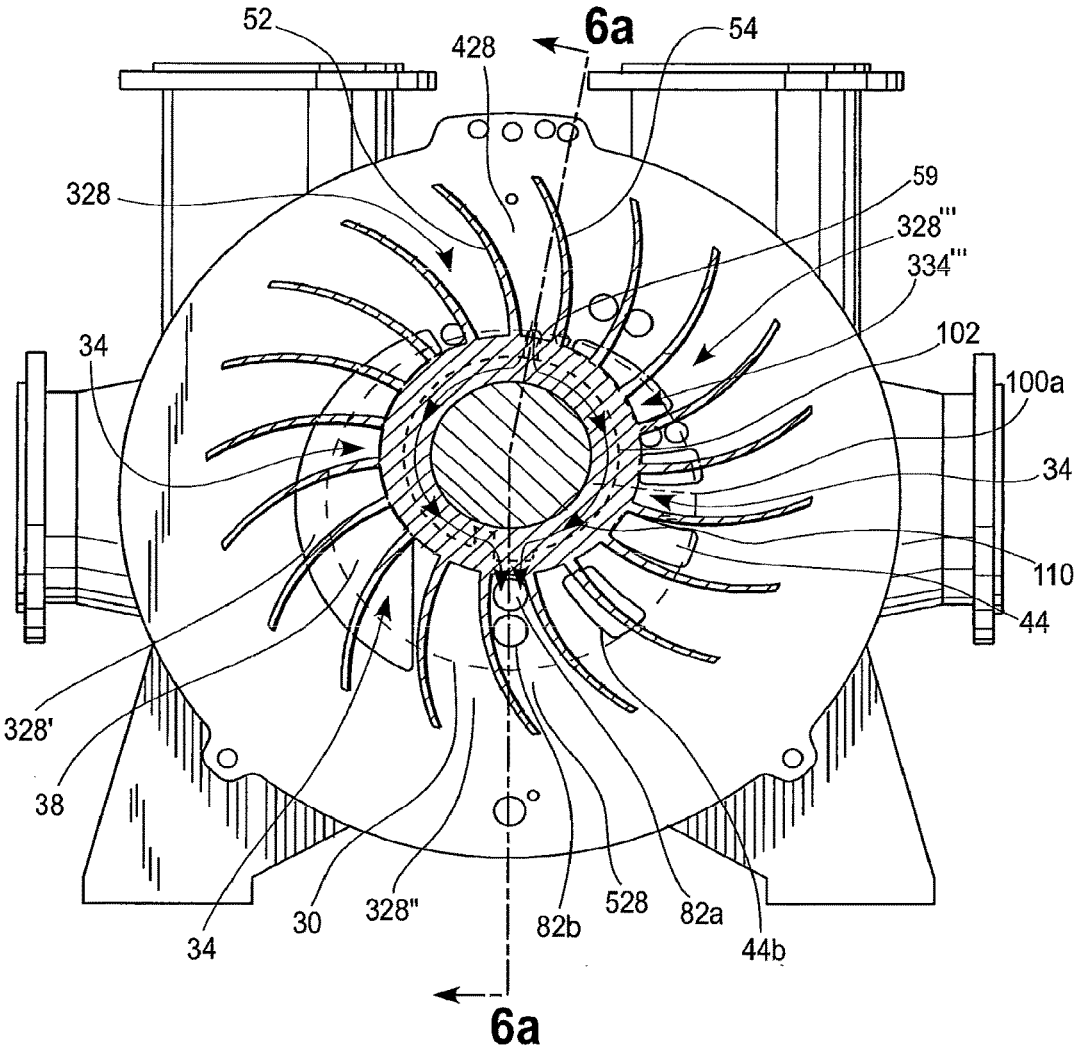
FIG. 5 is same as FIG. 4 except arrows have been drawn to show the flow of air as it passes through the gas scavenge channel and except the rotor has not been cut away.
Figure 6A:
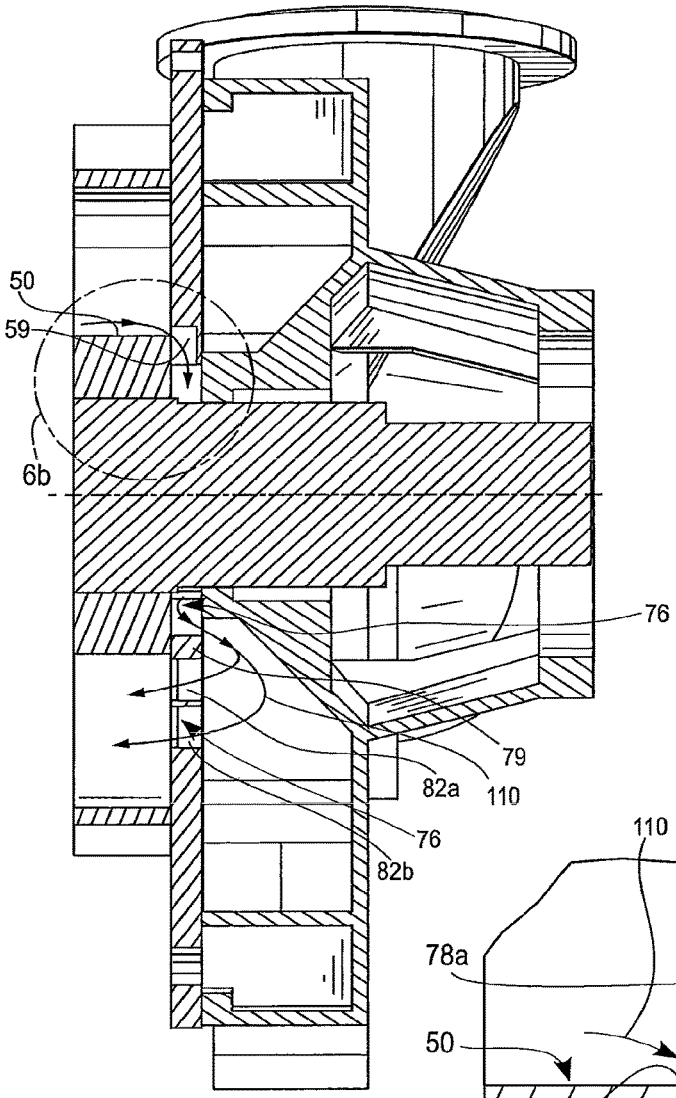
FIG. 6*a* is an irregular sectional view of the assembly shown in FIG. 5; the section is taken to extend through the radial length of the passage in the port plate which scavenges air and to extend through and be parallel with the central axis of the shaft and rotor.
Figure 6B:
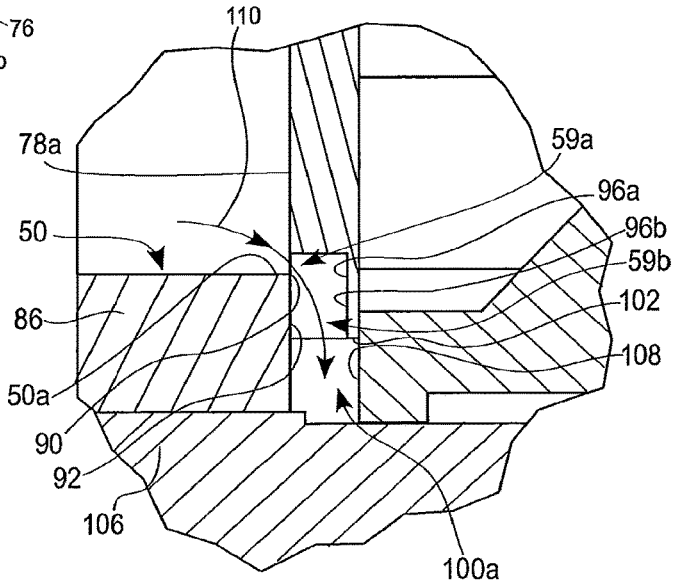
FIG. 6*b* is the close-up detail indicated at 6*b* of FIG. 6*a*.
Figure 7A:
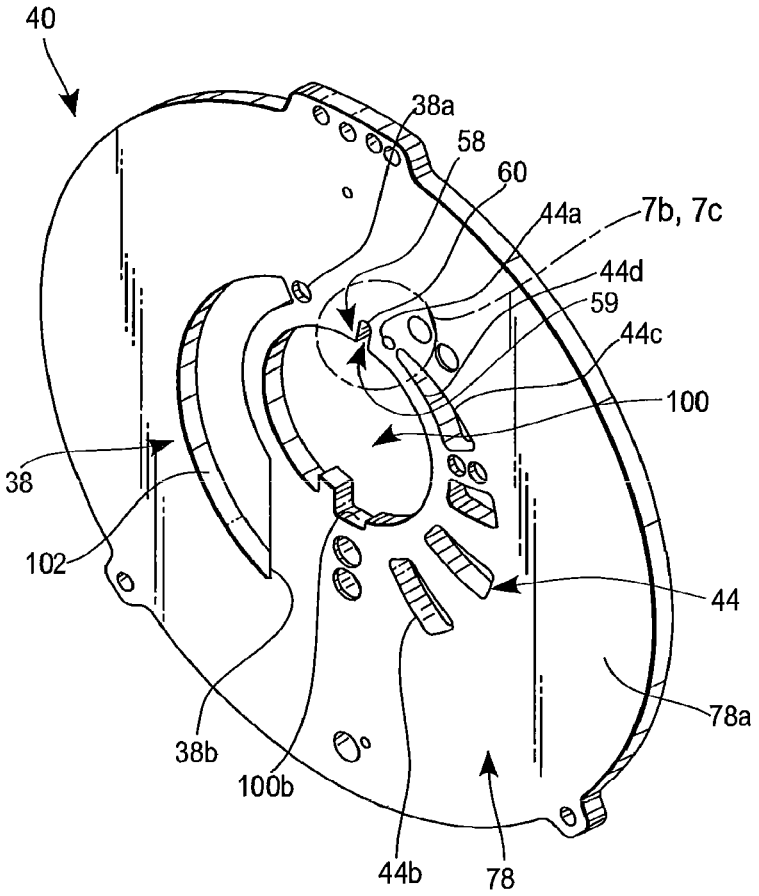
FIG. 7*a* is an isometric view of the port plate shown in FIG. 2 looking into a first face of the port plate; the first face faces the rotor.
Figure 7B:
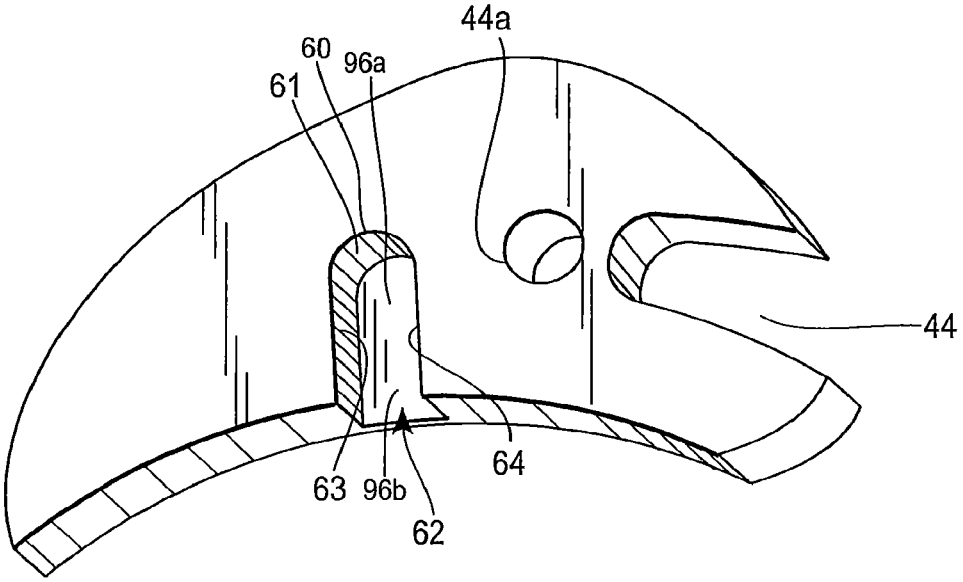
FIG. 7*b* is a close up of the detail shown in FIG. 7*a* at 7*b*, the detail isometricaly looks into the first face.
Figure 7C:
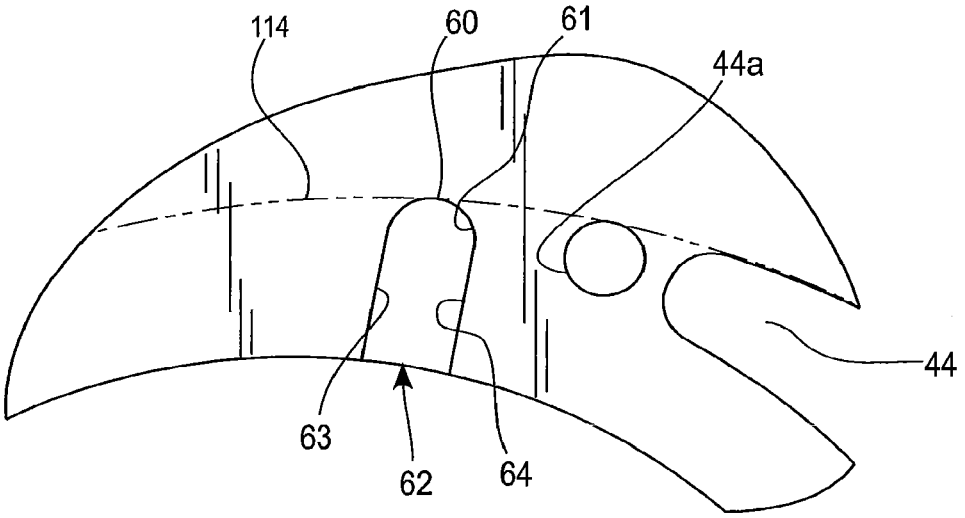
FIG. 7*c* is a close up of the detail shown in FIG. 7*a* at 7*c*, the detail looks into the first face.
Figure 8:
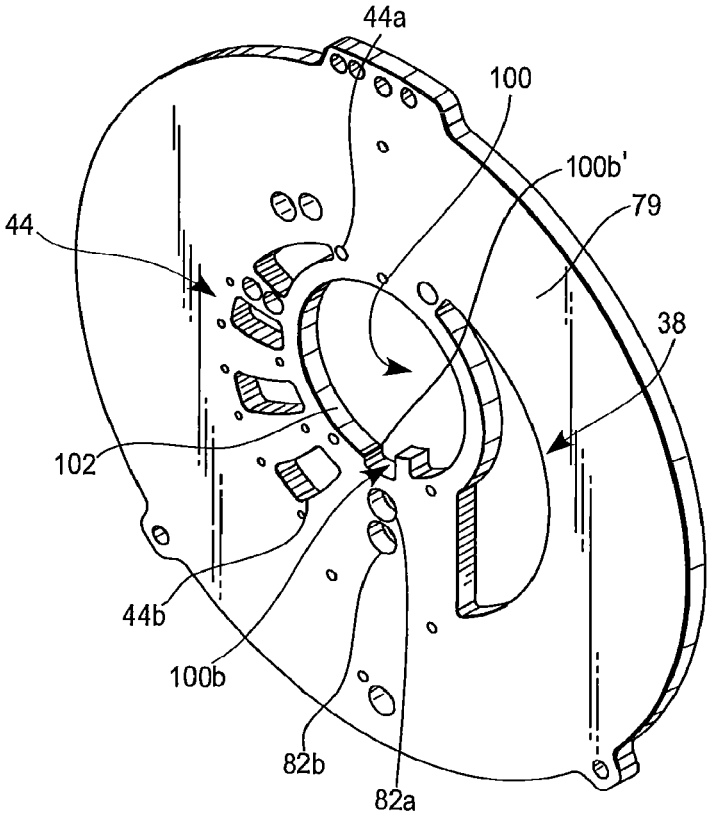
FIG. 8 is an isometric view of the port plate of FIG. 7 looking into a second face of the port plate; the second face faces the pump head.

While embodiments of this invention can take many different forms, an embodiment thereof is shown in the drawings and will be described herein in detail with the understanding that the present disclosure is to be considered as an exemplification of the principles of the invention, and is not intended to limit the invention to the specific embodiment illustrated.

The below description uses the term air when describing the invention. The term air includes ambient air and air made suitable for the application in which the liquid ring pump embodying the invention is used. The invention can also be used in connection with gases and mixtures of air and gases. It can be used in connection with any compressible fluid suitable for being conveyed through the inlet 47 and outlet 46 of a flat sided liquid ring pump.

Now referring more particularly to the Figures, a flat sided liquid ring pump 20 is shown. The pump 20 has a rotor 22. The rotor 22 has a plurality of 19 blades 24 which are arranged around a central area of the rotor. More particularly they are arranged circumferentially about the rotors central axis 26. The blades are equidistantly spaced from each other. The blades extend from surface 88 of hub 86. The rotors central axis, the rotor hubs central axis, the shafts central axis, and the central axis of the shaft receiving aperture in the port plate 40 are coextensive and shown as axis 26. The blades 24 are arranged so that each blade 24 is adjacent at least two other blades of said plurality of blades 24. Between each pair of adjacent blades is a space which can be called a bucket 28. There are a total of 19 buckets 28. Each bucket, when the liquid ring pump is operating at its running speed, forms a separate chamber which has a volume which expands and contracts depending on the angular orientation of the bucket 28 relative to a surface 30 forming an inner ring of the rotating liquid ring. The surface 30 delimits a radial inner boundary of the liquid ring. The liquid ring surface 30 forms a radial outer boundary of a respective chamber 34 formed in each bucket 28. The radial inward boundary of each chamber 34 and bucket is formed by hub's 86 radially outward surface 88. Each chamber 34 can be called a compressible fluid receiving chamber 34. There are 19 chambers. A bucket 328 and its chamber 334 of the 19 buckets 28 and 19 chambers is at starting point A. The bucket 328 rotates in direction of rotation 36 an amount to overlap and sweep by an air inlet 38 of the port plate 40. As the bucket 328 rotates to overlap the inlet 38, the surface 30 forming the inner diameter of the rotating liquid ring diverges radially away, in a first radial direction 42, from central axis 26 of the rotor 22. As the surface 30 diverges, the volume of the chamber 334, formed by the bucket 328 rotating to overlap the inlet, expands. As the bucket is rotating by the inlet its chamber 334 opens into the inlet 38 and overlaps the inlet and thus air is drawn into the expanding volume of the chamber formed by the bucket. Bucket 328' and its expanded chamber 334' exemplify bucket 328 and its chamber 334 overlapping with the inlet 38 as it rotates by the inlet 38. Bucket 328' and chamber 334' are part of the 19 buckets 28 and 19 chambers 34. As bucket 328 which rotates and sweeps by the inlet 38 continues to rotate in the direction 36, the surface 30 continues to diverge in the first radial direction 42 away from the rotor's central axis 26. As the surface 30 diverges, the volume of the chamber formed in the bucket continues to increase. Bucket 328" and its chamber 334" exemplify bucket 328 swept past the inlet 38 as its chamber increases in volume. Bucket 328" and chamber 334" are part of the 19 buckets 28 and 19 chambers 34. As the bucket rotates in direction 36 it overlaps the port plate outlet 44. The surface 30 of the liquid ring converges towards rotor central axis 26 in a second radial direction 43. The volume of the chamber decreases. The chamber also opens into and overlaps the port plate outlet 44. Therefore air trapped in the chamber of the bucket exits the bucket's chamber through the port plate outlet 44 and through the liquid ring pump outlet 46. Bucket 328''' and its chamber 334''' exemplify bucket 328 and its chamber 334 as the chamber opens into and overlaps the port plate outlet 44.

During rotation of the bucket 328 past the outlet 44, the surface 30 does not typically converge radially inward enough to completely collapse the volume of the bucket's chamber 334. Bucket 428 exemplifies bucket 328 at this position. The non-collapsed chamber 334 at this position is shown as 434. As can be seen, at an angular and circumferential point 48 between the closing edge 44*a* of the outlet port 44 and opening edge 38*a* of the inlet port 38, the surface 30 does not contact the surface 50 delimiting a radial inward boundary of bucket 428. The bucket 328, shown as bucket 428, has rotated to overlap the point 48. The bucket 328 as it overlaps point 48 is shown as bucket 428. Thus at the point 48 there is an open space shown as 434 that exists between the surface 30 and surface 50. The open space 434 is angularly and circumferentially between a leading blade 52 and a trailing blade 54 delimiting bucket 428. The open space 434 is also between inward bucket surface 50 and surface 30. The open space thus forms a volume of a chamber 434 of the bucket 428. The volume of chamber 434, is the volume of chamber 334 of bucket 328 after bucket 328 has rotated past outlet 44 and before it has rotated to overlap the inlet 38. As stated the bucket 328 in this position is shown as bucket 428. Bucket 428, in the above orientation, does not overlap either the inlet 38 or outlet 44. Bucket 428 does not open into the outlet or inlet. The bucket is between the inlet 38 and outlet 44. More particularly the bucket is between closing edge 44*a* of the outlet 44 and the leading edge 38*a* of the inlet 38. The tip 54*a* of the trailing blade 54 of the bucket 428 in the above orientation is at the landline. The landline position is when the tip of a rotor blade, during the blade's 360 degree rotation about axis 26, becomes closest to the internal surface 56*a* of the housing 56. Also in the above described position of bucket 428, the leading blade 52 and trailing blade 54 of the bucket 428 will each next rotate and sweep past, in the direction of rotation 36, the leading edge 38*a* of the inlet 38 and the inlet 38 before they rotate and sweep past the outlet 44. Accordingly the length between the tip 54*a* of the trailing blade 54 and the closing edge 44*a* of the outlet 44 is less than the length between the tip 54*a* of the trailing blade 54 to the leading edge 44*b* of the outlet 44. The length between the tip 52*a* of the leading blade 52 and the leading edge 38*a* of the inlet 38 is less than between the tip 52*a* of the leading blade 52 to closing edge 38*b* of the inlet 38. The lengths being measured are in a straight line. Also in the above described position, the bucket 428 trailing blade 54 has a leading surface 54*b* defining a trailing end of the bucket 428. The leading surface 54*b* has rotated and swept past, in direction 36, of the closing edge 44*a* of the outlet 44. The leading surface 54*b* is thus between the closing edge 44*a* of the outlet 44 and the leading edge 38*a* of the inlet. The bucket 428 leading blade 52 has not yet rotated in direction 36 to overlap the inlet 38. The leading blade 52 is between the closing edge 44*a* of the outlet 44 and the leading edge 38*a* of the inlet 38.

A channel or passage has a first 58, second 66 and third 76 channel portion or passage. The first channel portion 58 is formed in the port plate 40. The first channel portion has an opening which opens through a portion of a surface 78*a* forming a first face 78 of the port plate 40. The opening 59 does not open through the port plate. The opening forms an open portion of the first channel portion. The opening is an open side which extends an entire length of the first channel portion as measured from a first end 60 to a second end 62 of the first channel portion. The second end 62 is radially inward of the first end 60. At least a portion of the opening 59 that opens through a portion of the first face surface 78*a* overlaps the bucket 428. The overlapping portion, which can be called the first section 59*a* of the first channel portion 58, opens into the chamber 434 of the bucket 428. The first section 59*a* overlaps the chamber 434. The first section 59*a* thus opens through a portion of the surface 78*a* forming the first face of the port plate. The bucket 428 is in a high pressure zone of the working chamber 80 of the liquid ring pump 20. Compressible fluid, which in this example is air, trapped in the chamber 434 exits the chamber 434 and enters the first channel 58 at the opening 59 and more particularly at the first section 59*a*. The air enters the first section 59*a* and travels through the first section 59*a*. The air travels through the channel made of portions 58, 66 and 76. The air exits the channel into a chamber 534 of a bucket 528 that is between the closing edge 38*b* of the inlet 38 and leading edge 44*b* of the outlet 44. The bucket 528 is in a low pressure zone of the liquid ring pump's working chamber 80 relative to bucket 428. There is more pressure in bucket chamber 434 than in bucket chamber 534. Bucket 528 and chamber 534 are one of the 19 buckets 28 and chambers 34. The channel thus allows for air trapped in bucket 428 to escape bucket 428 before it is carried by bucket 428, during rotation in direction 36, to overlap the inlet 38. By allowing air trapped in the chamber 434 to avoid being carried over to the inlet 38, the chamber, when its volume expands as it sweeps by the inlet, as shown by bucket 328' and chamber 334', will have and exert a greater vacuum and thus be able to take in more air. Arrows 110 show the compressible fluid as is travels through channel portions 58, 66 and 76. On some occasions the surface 30 may contact boundary surface 50 and close chamber 434 such that it has no volume. It may also contact the boundary surface of bucket 328 such that chamber 434 has no volume and is completely collapsed. In these cases the ring will not collapse.

In more detail bucket 528, in the low pressure zone, has a trailing blade 528*b* that has a leading surface 528*b'* that has moved in the direction of rotation 36 past the closing edge 38*b* of the inlet 38 and the leading blade 528*a* of the bucket has yet to rotate in direction 36 enough to overlap the outlet 44. The bucket 528 is between the inlet 38 and outlet 44. It does not open up into or overlap the inlet 38 or outlet 44. The trailing 528*b* and leading 528*a* blades are between the inlet and outlet. The leading blade 528*a* and trailing blade 528*b* of the bucket 528 and the bucket 528 will each next rotate and sweep past, in the direction of rotation 36, the outlet 44 before they rotate and sweep past the inlet 38. The length between the tip 528*b*" of the trailing blade 528*b* and the leading edge 44*b* of the outlet 44 is less than the length from the tip 528*b*" of the trailing blade 528*b* to the closing edge 44*a* of the outlet 44. The length between the tip 528*a'* of the leading blade 528*a* and the closing edge 38*b* of the inlet 38 is less than from the tip 528*a*, of the leading blade 528*a* to the leading edge 38*a* of the inlet 38. The lengths are measured along a straight line.

Now referring back to the channel, the air travels through the first channel portion 58 into and through the second channel portion 66. The air next travels from the second channel portion 66 into and through the third channel portion 76. The air exits the third channel portion 76 and enters the bucket 528 through an aperture. The aperture is divided into a first 82*a* and second 82*b* aperture by portions of the port plate 40. The aperture, made of apertures 82*a*, 82*b*, forms the end part of the third channel portion 76. Thus the channel 58, 66 and 76 opens into bucket 528 through aperture 82*a*, 82*b*. The aperture 82*a*, 82*b* opens through the port plate. The aperture 82*a*, 82*b* is angularly between and circumferentially spaced between the closing edge 38*b* of the inlet 38 and leading edge 44*b* of the outlet 44. A length measured from the any part of the aperture 82*a*, 82*b* to the inlet's closing edge 38*b* is less than a length measured from any part of the aperture 82*a*, 82*b* to the outlet's 44 closing edge 44*a*. A length measured from any part of the aperture

82*a*, 82*b* to the outlet's 44 leading edge 44*b* is less than a length from any part of the aperture 82*a*, 82*b* to the inlet's 38 leading edge 38*a*. The lengths are measured along a straight line. The aperture 82*a*, 82*b* does not overlap or open into the inlet 38 or outlet 44. The aperture is radially outward of radially inward boundary surface 84 delimiting the radially inward surface of bucket 528. The inward boundary surface 84 is formed by a portion of the hub's radially outward surface 88. The aperture 82*a*, 82*b* opens into bucket 528 and is between the buckets trailing 528*b* and leading 528*a* blade. The aperture overlaps bucket 528. The aperture 82*a* 82*b* also provides an opening for liquid used to form the liquid ring to enter the working chamber 80 in which the liquid ring rotates during operation of the pump 20 at running speed.

The first section 59*a* and indeed the entire opening 59 is angularly between and circumferentially spaced between the closing edge 44*a* of outlet 44 and leading edge 38*a* of inlet 38. A length measured from the first section 59*a* and indeed any part of the opening 59 to the inlet's leading edge 38*a* is less than a length measured from any part of the opening 59 to the outlet's leading edge 44*b*. A length measured from the first section 59*a* and indeed any part of the opening 59 to the outlet's closing edge 44*a* is less than a length measured from any part of the opening 59 to the inlet's closing edge 38*a*. The lengths are measured along a straight line. The first section 59*a* and indeed the entirety of the opening 59 do not open into the outlet 44 or inlet 38. A portion of the opening 59 is axially across from and adjacent an axial delimiting end 90 of the surface 50 which delimits the radial inward boundary of bucket 428. The surface 50 which delimits the inward boundary of bucket 428 is as stated a portion of the rotor hub's radially outer surface 88. The surface 50 and the hub's radially outer surface 88 are circumferential. The first section 59*a* extends outward in the radial direction 42. It is radially outward of the axial end 90 and the portion of the boundary surface 50 delimited by the end. It is radially outward of the entire boundary surface 50 and the hub's radially outer surface 88. The opening 59 is bounded and closed at the first end 60 by an end wall 61 which is rounded, has a u shape, and has a peak at 60. The end wall 61 delimits a closed end of the opening 59 and a closed end of the first section 59*a*. The first end 60 and at least a portion of the end wall 61 are radially outward of the boundary surface 50. No portion of the port plate 40 delimiting the opening 59 of the first channel portion is more radially outward from the boundary portion 50 than the portion of the end wall 61 which delimits the first end 60.

A length measured from the portion 60 of the first section most radially outward from the boundary surface 50 to the internal surface 56*a* of the housing 56 enclosing the rotor 22 is X. The length is measured along a radius extending from the rotor's central axis 26. A length measured from the portion of the boundary surface 50 delimited by the axial end 90 to the internal surface 56*a* of the housing 56 is Y. The length is measured along a radius extending from the rotor's central axis Y is greater than X. A length measured from the rotor's central axis 26 to the portion of the boundary surface 50 delimited by the axial end 90 is Q. The portion delimited is shown at 50*a*. The distance is measured along a radius extending from the rotor's axis 26. A length measured from the rotor's central axis 26 to the most radially outward portion 60 of the first section is R. The distance is measured along a radius extending from the rotor's axis 26. R is greater than Q. A length measured from the rotor's central axis 26 to the inner surface 30 of the liquid ring is Z. The length is measured along the radius that the distance R was measured. Z is greater than R. As shown no part of the first section 59*a* or any part of the opening 59 opens into the liquid ring. As the liquid ring surface can converge and contact surface 50, opening 59 may open into the liquid ring. Also a portion of the opening 59*a* may open into the liquid ring from time to time without collapsing the ring.

P is the length measured from a portion 60 of the first section most radially outward to the boundary surface 50. The length is measured along a radius extending from the rotor's central axis 26. The length is no greater than the length of a shortest radius from the central axis to the curve path 114 fit along a radial outer sidewall 44*c* of the outlet 44.

The radial outer sidewall is a portion of the port plate that delimits a boundary of the outlet in the radial outward direction 42. A radial inner sidewall 44*d* delimits a boundary of the outlet in the radial inward direction 43.

The first channel portion 58 has a portion which extends radially inward from the first section 59*a* to the second end 62. The first 60 and second ends 62 of the opening 59 and the first channel portion 58 are aligned along a straight line. The portion extending radially inward of the first section 59*a* has an opening which can be called a second section 59*b*. The second section 59*b* is continuous with the first section 59*a*. The second section 59*b* is continuous with the second end 62. The second section 59*b* is radially inward of the boundary surface 50 and the hub's radially outward facing surface 88. The second section 59*b* is overlapped by a portion of an axial facing surface 92 of the hub 86. The axial facing surface 92 faces the first surface 78*a* of the port plate 40. In the present construction the entire second section 59*b*, except any portion that opens through a portion of the port plate 20 extending radially inward of hub inner circumferential surface 94, is overlapped by the portion of the axially facing surface 92. The entire second section 59*b* opens through a portion of the first facing surface 78*a* of port plate 40. The entire second section 59*b* forms a portion of opening 59. The portion of the axial facing surface 92 is bounded, in the radial outward direction by boundary surface 50 and the radial inward direction by radially inward facing circumferential hub surface 94. The portion of the axial facing surface 92 faces a surface 96*a* of the port plate 40 forming a base of the second section 59*b*. The surface 96*a* can be called a base surface 96*a*. The base surface 96*a* delimits the second section in an axial direction going away from the port plate first face surface 78*a* and towards the port plate second face surface 79. A base surface 96*b* formed by a surface of the port plate also delimits the first section 59*a* in an axial direction going away from the port plate first face surface 78*a* and towards the port plate second face surface 79. The base surface 96*b* of the first section and the base surface 96*a* of the second section are continuous. The bases can be formed by a portion of the pump head as opposed to the port plate.

The bases form a single base surface of the first channel portion 58. The single base surface 96*a*, 96*b* is spaced in the axial direction from the first face surface 78*a* and delimits the opening 59 in the axial direction going away from the port plate first face surface 78*a* and towards the port plate second surface 79. The opening 59 has a width, measured from a first side wall 63 to a second sidewall 64 of the first channel portion 58. The width is about 'X to % the width of the bucket 428. The width of the opening 59 is the arc length between the sidewalls. The arc length has a radius extending from the rotors central axis 26. The arc length is taken along the arc drawn between the sidewalls at a point on each sidewall; the point is radially inward of the first end 60; and the point is midway between, in the radial direction 43, the bounding surface 50 of the hub 86 and the hub's inner circumferential surface 94. The width of the bucket is the arc length between the trailing blade 54 and leading blade 52 of the bucket 428. The arc length is drawn between the bases of each blade. The base is the point where the blade first extends radially outward from the boundary surface 50 formed by the hub. The arc length has a radius extending from the rotors central axis. The arc length can be formed between the trailing blade 54 and leading blade 52 along surface 50. Put another way the angular distance between the sidewall 63 and sidewall 64 of aperture 59, measured from the central axis 26, is 'X to % the angular distance between the base of a trailing blade and leading blade of a bucket measured from the central axis.

The shortest angular distance from the centerline of opening 59, when the centerline is drawn along a radius from the central axis, to the closing edge is % the angular distance between a trailing blade and leading blade of a bucket measured at the base of each blade. The vertex of the angle is a point on the central axis.

The opening 59 has a length measured as a straight line from the first end 60 to the second end 62. The bucket 428 has a length measured as a straight line from a rotor tip 52*a* of the leading blade 52 to the boundary surface 50. The length of the opening is % to % the length of the bucket.

The first sidewall 63 of the opening is continuous and integral with a first portion of the end wall 61. The second sidewall 64 is continuous and integral with a second portion of the end wall 61. The first and second sidewalls 63, 64 are spaced apart and opposite each other. The first sidewall 63 delimits the opening in the first circumferential direction 36 and the second sidewall 64 delimits the opening in the second circumferential direction 37. The first and second sidewalls extend radially inward to the second end 62.

The second section 59*b*, at the second end 62, opens into an aperture 100. The aperture is radially inward of and does not open into the outlet 44, inlet 38, buckets 34, and third channel portion aperture 82*a*, 82*b*. The aperture 100 is circumscribed by sidewall 102 formed in and from the port plate 40. The second section 59*b* opens into the aperture 100 through side wall 102. The air thus travels from the first section 59*a* into and through the second section 59*b*. In the second section 59*b*, the air travels between the second section base 96*a* and the hub's axial face surface 92 and into the aperture 100. The first 59*a* and second 59*b* sections form a single continuous opening which extends from the first end 60 to the second end 62 and directs air from the bucket 428 into the aperture 100. The aperture receives a portion of the rotor shaft 106.

There is an open space 100*a* between the sidewall 102 and the portion of the shaft 106 outer surface radially opposite the sidewall 102. The space 100*a* is continuous and extends 360 degrees around the portion of the shaft 106 opposite the sidewall. The open space 100*a* receives air from the second section 59*b* opening at second end 62 at and into aperture 100. The open space 100*a* forms the second channel portion 66.

The sidewall 102 has a portion which defines an opening 100*b* through the port plate 40 which extends radially outward in direction 42 from aperture's 100 central axis. It also extends radially outward from portions of the side wall 102 defining an open end 100*b*' of the opening 100*b*. The opening 100*b* can be called a notch or slot. Air received in the open space 100*a*, second channel portion 66, from the first channel portion 58 exits the open space 100*a* through the notch 100*b*. The air travels through the notch 100*b* in the axial direction away from the hub axial facing surface 92 and towards the pump head 108. The air, after it passes through the notch 100*b*, loops around a portion of the port plate second facing surface 79 and travels through aperture 82*a*, 82*b* in an axial direction away from the pump head and towards the rotor hub 86 and into bucket 528. The passage from the space 100*a*, and more particularly notch 100*b*, through the aperture 82*a*, 82*b* is the third channel portion 76.

The hub's circumferential inner surface 94 forms an opening which receives the rotor shaft 106. The rotor 22 is fixedly mounted to the shaft 106. The port plate 40 is between the rotor 22 and the pump head 108 and in particular the plurality of blades 24 and the head 108. Rotation of the shaft 106 rotates the rotor 22. The buckets 28 formed by the rotor 22 all rotate as the bucket 328 described above.

In more detail, the rotor 22 is a flat sided rotor. The flat side 22*a* of the rotor is adjacent and faces the port plate 40. Each blade 24 of the plurality of blades, at the flat side 22*a* of the rotor 22, has a radially extending surface 24*a*. The surface extends from the tip end 24*b* of the blade to the end of the blade 24*c* at the hub 86. The surface 24*a* is unbent and un-curved. The surface 24*a* of each blade is flush with the axial facing surface 92 which faces in the axial direction towards the pump head. The surface 24*a* is at a right angle to the hub's circumferential outer surface 88. The end of each blade 24*c* at the hub is at a right angle relative to each blade's surface 24*a*. The end 24*c* of the blade 24 is integral with the hub 86 and more particularly hub surface 92.

Compressible fluid, which in this example is air, enters pump head 108 through head inlet 47. It enters working chamber 80 though inlet 38. It exits working chamber 80 through outlet 44. It exits the head through outlet 46.

The head 108 has an auxiliary inlet 47' and auxiliary outlet 46' which in this case are sealed off. The port plate is substantially planar. When the liquid ring pump is operating at running speed the channel portions 58, 66, 76 are each substantially sealed-off from the inlet and outlet; the inlet and outlet are sealed-off from each other; the buckets, but for channel 58, 66 and 76, are sealed-off from each other; and all the buckets accept when in the position of buckets 528 and 428 are sealed-off from each other.

The outlet 44 is formed by a plurality of outlet sections. The plurality of outlet sections is separated from each other by portions of the port plate 40. The closing edge 44*a* of the outlet and leading edge 44*b* of the outlet delimit the plurality of sections in radial directions 42 and 43. The inlet 38 is formed by a plurality of inlet sections. The plurality of inlet sections is separated from each other by portions of the port plate 40. The closing edge 38*b* of the inlet and leading edge 38*a* of the inlet delimit the plurality of inlet sections in radial directions 42 and 43.

The hub's outer surface 88 delimits the radial inward boundary and forms the inward boundary surface of all buckets 28. The surface 88 is circumferential. The buckets are all the same.

The phrases "radially outward" and "radially inward" are relative phrases and in relation to the rotor's central axis and the central axis of the shaft receiving aperture of the port plate. A point or construction of the liquid ring pump radially outward of another point or construction is further from the central axis than the other point as measured in the radial direction. The term "leading" and "trailing" are relative terms in relation to the direction of rotation of the rotor. Thus a leading blade of a bucket is a blade that passes a point as the rotor is rotated in a direction of rotation 42 before the trailing blade. A "closing edge" and a "leading edge" are relative terms and also in relation to the direction of rotation of the rotor. A closing edge is an edge passed by a rotor blade, rotating in the direction of rotation, after the blade has passed the leading edge.

All of the features disclosed in this specification (including any accompanying claims, abstract and drawings), and/or all of the steps of any method or process so disclosed, may be combined in any combination, except combinations where at least some of such features and/or steps are mutually exclusive.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A liquid ring pump comprising:

a pump head;

a planar port plate coupled to the pump head and having a sidewall which defines a shaft receiving aperture that passes through the port plate in an axial direction, the shaft receiving aperture defining a first port plate diameter, the port plate defining an inlet having an inlet closing edge and an inlet leading edge, and an outlet having an outlet closing edge and an outlet leading edge, each of the inlet and the outlet passing through the port plate;

an opening formed in the port plate and passing only partially through the port plate in the axial direction, the opening extending from the shaft receiving aperture to a second port plate diameter that is larger than the first port plate diameter;

a rotor shaft disposed in the shaft receiving aperture and having a shaft diameter, the shaft rotatable relative to the port plate about a central axis that extends along the axial direction, the shaft diameter and the first port plate diameter sized such that the rotor shaft and the side wall of the shaft receiving aperture cooperate to define a space therebetween;

a rotor fixedly coupled to the rotor shaft, the rotor having a hub and a plurality of blades extending from the hub and arranged about the central axis; and an aperture formed in the port plate and positioned substantially opposite the opening with respect to the shaft receiving aperture, the opening, the space defined by the cooperation of the rotor shaft, the hub, and the side wall of the port plate, and the aperture cooperating to define a channel between a high pressure region and a low pressure region, wherein the channel is formed entirely coplanar with the plane of the port plate.

2. The liquid ring pump of claim 1, wherein the plurality of blades cooperate to define a plurality of buckets with each bucket at least partially defined by two adjacent blades of the plurality of blades and the hub, and wherein a first of the buckets contains high pressure fluid and is positioned in fluid communication with the opening and a second bucket is positioned in fluid communication with the aperture to allow flow of the high pressure fluid from the first bucket to the second bucket.

3. The liquid ring pump of claim 2 wherein the hub has a radially outward facing surface that forms an inward boundary surface of the bucket, and has an axial facing surface which is parallel to and adjacent the first surface of the port plate, the axial facing surface partially enclosing the space.

4. The liquid ring pump of claim 3 further comprising:

a rotating liquid ring formed when the pump is operating at a running speed, the rotating liquid ring having a ring surface delimiting a radially inner surface of the rotating liquid ring;

a compressible fluid chamber formed in each bucket, the compressible fluid chamber defined by the cooperation of the ring surface, the two adjacent blades that at least partially defines the bucket, and the radially outward facing surface of the hub, and wherein the compressible fluid chamber overlaps each of the opening and the aperture in sequence during each revolution of the rotor.

5. The liquid ring pump of claim 2, wherein the first bucket has a surface delimiting a radial inward boundary surface of the bucket, and a first section extends radially outward of the inward boundary surface of the bucket to the second port plate diameter.

6. The liquid ring pump of claim 5 wherein an angular distance between a first sidewall and a second sidewall of the opening, measured from the central axis, is ¼ to ½ the angular distance between a base of a trailing blade and a base of a leading blade of the first bucket measured from the central axis, the base of each blade is the point where each blade first extends radially outward from a portion of the inward boundary surface; and wherein the angular distance is measured between the first and second sidewalls at a point on each sidewall radially midway between, in the radial direction, a radially outward surface of the hub and an inner circumferential surface of the hub, the inner circumferential surface forming an opening in which the rotor shaft is disposed.

7. The liquid ring pump of claim 1, wherein the sidewall forms a radially outward extending notch.

8. A liquid ring pump comprising:

a planar port plate having a first planar wall and a second planar wall;

a inner wall which defines a shaft receiving aperture opening through the port plate, an inlet defined by and extending through the port plate and including an inlet closing edge and an inlet leading edge;

an outlet defined by and extending through the port plate and including an outlet closing edge and an outlet leading edge;

an opening formed in the port plate and including an open end that extends through the inner wall and an open face that extends through the first planar wall;

a rotor shaft rotatable about a central axis and positioned such that a portion of the rotor shaft extends into the shaft receiving aperture; and an aperture formed in the port plate and positioned substantially opposite the opening with respect to the shaft receiving aperture, the opening, a space defined between the rotor shaft and the inner wall, and the aperture, cooperating to define a channel that extends between a first side of the shaft receiving aperture and a second side of the shaft receiving aperture, wherein the channel is formed entirely coplanar with the port plate.

9. The liquid ring pump of claim 8, wherein the opening passes through the first planar wall but does not extend through the second planar wall.

10. The port plate of claim 8, wherein the aperture is positioned angularly between the inlet closing edge and the outlet leading edge.

11. The port plate of claim 8 wherein one of the first planar wall and the second planar wall forms a radially outward extending notch.

12. The liquid ring pump of claim 8, wherein the rotor shaft includes a hub and a plurality of blades, and wherein any two adjacent blades of the plurality of blades cooperate to at least partially define one of a plurality of buckets.

13. The liquid ring pump of claim 12, wherein each bucket is at least partially defined by two adjacent blades of the plurality of blades and the hub, and wherein a first of the buckets contains high pressure fluid and is positioned in fluid communication with the opening and a second bucket is positioned in fluid communication with the aperture to allow flow of the high pressure fluid from the first bucket to the second bucket.

14. The liquid ring pump of claim 13 wherein the hub has a radially outward facing surface that forms an inward boundary surface of the bucket, and has an axial facing surface which is parallel to and adjacent the first surface of the port plate, the axial facing surface partially enclosing the space.

15. The liquid ring pump of claim 14 further comprising:

a rotating liquid ring formed when the pump is operating at a running speed, the rotating liquid ring having a ring surface delimiting a radially inner surface of the rotating liquid ring;

a compressible fluid chamber formed in each bucket, the compressible fluid chamber defined by the cooperation of the ring surface, the two adjacent blades that at least partially define the bucket, and the radially outward facing surface of the hub, and wherein the compressible fluid chamber overlaps each of the inlet and the outlet in sequence during each revolution of the rotor.

* * * * *